United States Patent [19]

Minato et al.

[11] 4,090,813

[45] May 23, 1978

[54] HIGH-EFFICIENCY TURBO-MACHINE IMPELLERS

[75] Inventors: Akira Minato; Tutomu Shimizu, both of Hitachi; Yosio Kanekiyo, Tsuchiura, all of Japan

[73] Assignee: Hitachi, Ltd., Japan

[21] Appl. No.: 685,696

[22] Filed: May 11, 1976

[30] Foreign Application Priority Data

May 14, 1975 Japan ..... 50-56150

[51] Int. Cl.[2] ..... F04D 29/28

[52] U.S. Cl. ..... 416/184; 416/241 R

[58] Field of Search ..... 416/185, 241, 186, 186 A, 416/184, 199

[56] References Cited

U.S. PATENT DOCUMENTS

| | | | |
|---|---|---|---|
| 3,650,845 | 3/1972 | Oda et al. | 416/241 X |
| 3,661,658 | 5/1972 | Oda et al. | 416/241 X |
| 3,664,765 | 5/1972 | Ishimatsu et al. | 416/241 |
| 3,729,345 | 4/1973 | Oda et al. | 416/241 X |
| 3,730,785 | 5/1973 | Conrad et al. | 416/241 X |
| 3,794,445 | 2/1974 | Watanabe et al. | 416/241 |
| 3,856,434 | 12/1974 | Hoffmann | 416/184 |
| 3,902,823 | 9/1975 | Minato et al. | 416/186 |

*Primary Examiner*—Everette A. Powell, Jr.
*Attorney, Agent, or Firm*—Craig & Antonelli

[57] ABSTRACT

A martensitic stainless steel to be used for the impellers of turbo-blowers, compressors and the like consisting essentially, based on weight of 0.04 - 0.15% C, up to 2.0% Si, 0.2 - 2.0% Mn, 3.5 - 6.0% Ni, 10 - 16% Cr, and at least one element selected from the group consisting of 0.5 - 3.0% Mo, 0.01 - 0.8% Nb, and the balance being Fe. The amounts of δ-ferrite therein is not more than 10%. The steel may further contain up to 0.2% additional element or elements, i.e., N, Al, Ti, Ca, and/or a rare-earth element or elements. The steel of this composition offers high strength, great toughness, and good weldability and, when annealed after welding, it will display the same properties as after quenching and tempering. Impellers made of this steel are for heavy-duty, high-efficiency applications.

24 Claims, 4 Drawing Figures

HIGH-EFFICIENCY TURBO-MACHINE IMPELLERS

This invention relates to impellers of turbo-blowers and compressors, and more specifically to a steel which offers sufficiently high strength and toughness and good weldability to provide high-efficiency impellers, with the properties upon annealing after welding being the same as those of the same steel subjected to tempering after hardening.

The tendency toward larger plants for thermal power generation, iron- and steel-making, cement, and chemical manufacture has combined with growing pollution problems of those plants to stimulate the demand for turbo-blowers and compressors of higher capacities than heretofore. Attempts have therefore been made to increase the size and power of those turbo-machines, for example, by increasing their pressures, and diameters and rotational speeds of their impellers. In the case of thermal power plants, there is a tendency to operation at elevated temperature and pressure for pollution control, as by desulfurization and denitrification. To meet these operating conditions it is often in practice to replace two existing blowers by a single blower of a larger capacity. For this reason the latter is required to exhibit adequate strength at elevated temperature as well as ordinary temperature. In order to bring such large impellers capable of high-speed rotation, not only advanced design and manufacturing techniques but also the supply of a high strength, high-toughness material are essential. The material should be easy to machine, weld or otherwise work and be suited for commercial production. From the viewpoint of pollution control, industrial waste gases must be efficiently desulfurized and denitrified at a pressure of about the atmospheric pressure plug 1,000 mm Ag or upwards and at a temperature of not lower than about 400° C. This is beyond the capacity and efficiency of the blowers and compressors now in use. Moreover, space limitations of the existing plants have made it practically impossible to incorporate larger and more efficient machines.

The impellers of ordinary turbo-blowers and compressors are mostly of riveted structure because they are designed to run at low speeds and at operating temperatures not exceeding about 350° C. Consequently, the blower and compressor efficiency is low and the rivets can loosen during operation, resulting in short life of the impellers. An additional disadvantage of the riveted structure is the necessity of many man-hours for its construction. On the other hand, attempts to make one-piece castings of practical use as substitutes for such riveted structures have failed because of the intricacy of the construction.

The materials that have hitherto been used for the impellers of turbo-blowers and compressors generally are either carbon steels where the impellers run at relatively low speeds and the stresses involved are small, or low alloy steels where the impeller speeds are high and the stresses are great. In recent years the steadily growing rate of air pollution and increasing temperature in industrial areas have unfavorable affected the strength and have corroded the impellers built of those materials, leading to reduced blower and compressor efficiencies with serious decreases in durability and reliability. In corrosive environments it has been customary to use ferritic, martensitic, or austenitic stainless steels. However, the ferritic and austenitic steels are not strong enough to stand high-speed rotations of impellers which develop high stresses, and hence the resulting impellers have low efficiencies. Martensitic steels, on the other hand, have self-hardening properties and the welds tend to crack on cooling. In order to avoid the cracking, some counter measures must be taken including increases in the preheating temperature and the temperature between passes. Solution of these problems in respect of weldability necessitates additional steps in the manufacture of the blowers and compressors. The martensitic grades can develop fairly high strength when their carbon contents are increased or their tempering is accomplished at lower temperatures than usual. However, the high strength attained by the increased carbon contents, at the same time, will sacrifice the toughness, corrosion resistance, and weldability of the steels, and the turbo-blowers and compressors built of those materials will have reduced efficiencies in spite of increased numbers of man-hours required for the manufacture. If the tempering temperature is lowered instead, the toughness and weldability will be seriously affected, again leading to inadequate fan efficiencies despite extra man-hour requirements. Fabrication of ordinary martensitic steels into welded structures has involved difficulties in the welding work, particularly when welders stand and stoop thereover for the work, because the impellers are large in size and the preheating temperature for the welding ranges from 250° C to 350° C. The difficulties in welding have often resulted in flaws in the welds. In the welded structure the welds are weaker than the base metal and therefore they must be hardened and tempered again after the welding so as to attain high strength and toughness. Actually, however, the impeller structures are so large in size and so complex in construction that they tend to be deformed upon hardening, with consequent drops in efficiency for increasing the volume and pressure of air being handled. If this shortcoming is to be eliminated, an additional number of man-hours will be needed to an economic disadvantage.

The present invention is directed to enhancement of the efficiencies of turbo-blowers and compressors and also to reduction of the number of man-hours required for the manufacture. More particularly, the invention has for its object to provide a steel of a chemical composition within ranges of proportion especially suited as steel material for the impellers of those turbo-machines, with high strength and toughness, weldability with preheating at lower-than-normal temperature, and properties upon stress-relief annealing after the welding comparable to the properties of the same steel after quenching and tempering.

This invention provides a martensitic stainless steel to be used for the impellers of turbo-blowers, compressors and the like, comprising 0.04 – 0.15% C, not more than 2% Si, 0.2 – 2.0% Mn, 3.5 – 6.0% Ni, 10 – 16% Cr, and one or more additional components of 0.5 – 3.0% Mo, 0.01 – 0.8% Nb, the balance being Fe. The steel of this composition offers high strength and toughness, good weldability, and will display, when annealed after welding, the same properties as after quenching and tempering. Thus, in accordance with the invention, the Ni content of the ordinary martensitic stainless steel is increased, with additions of Mo and Nb and some reduction of the C content. The resulting steel will not crack on welding even if the preheating temperature is below 150° C and, when stress-relief annealed after welding, it will be as strong and tough as after quenching and tempering. These features of the invention are beneficial for the manufacture of impellers that will enhance the efficiencies of the turbo-blowers and compressors.

A further advantage of the steel comprising the invention is that the nickel, molybdenum, and niobium contribute to the improvement in corrosion resistance, directly or indirectly.

According to the invention, each of the impellers for turbo-blowers and compressors, as shown in FIGS. 1 to 3, comprises a center plate 3, both side plates 1, and vanes or blades 2. The steel constituting those components, after quenching and tempering, has a Charpy impact value, with a U notch at 20° C of 8 kg-m/cm$^2$ or upwards and a tensile strength of over 70 kg/mm$^2$ at 450° C.

It has been confirmed that the turbo-blowers and compressors whose impellers are made of the high-strength steel of the invention achieve considerably higher efficiencies than those using impellers of ordinary carbon steel or low alloy steel. The steel having a tensile strength of over 70 kg/mm$^2$ at 450° C makes it possible for the impeller to rotate faster than the conventional impellers at room temperature and run at even higher speeds at higher temperature. For this reason the discharge efficiency can be remarkably improved. Furthermore, the problem of space limitation in the existing installations can be settled. Usually when the working pressure of a conventional turbo-blower or compressor is set to the atmospheric pressure plus 1,000 mm Ag, a carbon steel with a tensile strength of 60 kg/mm$^2$ at room temperature is used because the peripheral speed of rotation of the impeller will be about 200 m/sec. With the temperature rise of the gas being discharged to about 400° C or upwards, the gas density will decrease. We have found that, in such a high temperature range, a high efficiency is attained by using a steel with a tensile strength of over 70 kg/mm$^2$ at 450° C and that if the tensile strength at 450° C is below this level adequate efficiency will not result.

In the martensitic stainless steel of the invention to be used for impellers, the δ-ferrite content is limited to 10% or less. This has been found to increase appreciably the resistance to fatigue fracture due to high-speed rotation of the impellers. We have found that the δ-ferrite grains can assume such a substantial proportion in the steel as to cause stress concentration and seriously affect the fatigue strength. If the amount is less than 10%, it will not have a material effect upon the fatigue strength and will not reduce the blower or compressor efficiency. Conversely if the amount exceeds 10%, the fan efficiency will sharply drop because of lowered fatigue strength. The δ-ferrite content of the steel is generally controlled by the Cr equivalent in the following way.

$$\text{Cr equivalent} = \text{Cr} + 6\text{Si} + 4\text{Mo} + 5\text{Nb} - 40\text{C} - 2\text{Mn} - 4\text{Ni} - 30\text{N}$$

where each element is in percent by weight. With this Cr equivalent being 12 or more the δ-ferrite content will exceed 10%.

It has also been found that, with not more than 10% retained austenite, the martensitic steel of the invention for impellers attains high strength and toughness at high temperature and also exhibits good weldability for the manufacture of efficient impellers. Usually the presence of retained austenite improves the elongation and contraction percentage of the steel at elevated and room temperatures and also enhances the impact resistance, making it possible to use a preheating temperature of not higher than 150° C for welding. As a result, the steel is welded with ease and the danger of weld crack is greatly reduced. If the retained austenite exceeds 10%, the steel wil show a sharp decrease in strength, particularly at high temperature, and will not give a highly efficient impeller. Thus, it has been found that, when the amount of retained austenite is limited to 10% or less as under the invention, the steel will become easily weldable and have high strength, particularly at elevated temperature, and great toughness, all desirable for the manufacture of efficient impellers for high temperature use. The amount of retained austenite can be controlled by adjusting the steel composition and the tempering temperature after hardening. The composition of the steel being the same, the retained austenite content will be reduced to less than 10% upon tempering at below 600° C. Less than 10% retained austenite slightly improves the damping capacity and therefore enables the impeller made of the steel to reduce the noise during high-speed operation. Over 10% retained austenite, by contrast, reduces the damping capacity and brings a noisy, low-efficiency impeller.

The martensitic stainless steel of this invention for impellers comprises, all by weight, 0.04 - 0.15% C, not more than 2% Si, 0.2 - 2.0% Mn, 3.5 - 6.0% Ni, 10 - 16% Cr, and one or more additional components of 0.5 - 3.0% Mo, 0.01 - 0.8% Nb, at least one element selected from the group consisting of up to 0.2% each of N, Al, Ti, Ca and/or a rare-earth element or elements. The steel of this composition has been found to be much stronger and tougher and have better weldability than conventional steels of the character and be useful for high-efficiency impellers.

It has been experimentally confirmed that an impeller whose center plate, side plates, and blades range in wall thickness from 0.5 to 1.5% of the impeller diameter will achieve an appreciable sound-arresting effect during operation because the selected thickness ratio favorably combines with the afore-mentioned tensile strength at 450° C and impact resistance value at 20° C of the steel. For example, a 2,000 mm-dia. impeller having a plate thickness between 10 and 30 mm attains an effect to dampen the noise due to the wind pressure required and the resonance produced between the blades. Experiments have also indicated that the centrifugal force that results from rotation of the impeller can be adjusted to an adequate value from the relation between the strength and toughness of the plate material. If the plate thickness is less than 0.5% of the impeller diameter, the high-speed running of the impeller will cause violent resonance and vibration between the blades, deformation of the side plates and center plate, and a material decrease in the efficiency of the blower or compressor. If the percentage exceeds 1.5, the plates and blades will stand the impeller rotation well but the overall weight will be so heavy that the efficiency will again be sacrificed to a serious extent.

In accordance with the invention, the center and side plates and blades of the impellers are joined by welding, the components being made of a steel which will not crack on welding after preheating at lower than 150° C and which will be imparted with the properties of steel after quenching and tempering by stress-relief annealing following the welding. The temperature between passes will be under 150° C, too. It has now been found that, in contrast to the conventional impellers of riveted structure which have very low efficiency and short life, the welded impellers of the invention attain improved efficiency. Attempts have hitherto been made in vain to build impellers from martensitic stainless steels of the character by welding. For the welding of such impellers, particularly those one meter or larger in diameter, the steels must be preheated at from 250° to 350° C in order to preclude weld cracking. The high-temperature preheating makes the welding operation quite difficult, leading to many flaws in the welds and reduced efficiencies of the turbo-blowers and compressors. Under the invention, by contrast, it has now been found that the steel having a tensile strength of over 70 kg/mm$^2$ at 450° C and a U-notch Charpy impact value of over 8 kg-m/cm$^2$ and which will not crack on welding after preheating at below 150° C is easily fabricated by welding to impellers having diameters of more than one meter with a remarkable decrease of defects in the welds, thus enhancing the efficiencies of the turbo-blowers and compressors using such impellers. Even the steel that is easier to weld and produces less flaws in the welds may sometimes form welds which are not so strong and tough, and therefore the strength and toughness must be improved by a heat treatment after welding. Usually the treatment is in the form of quenching and tempering, but the large impellers measuring one meter or more across are so complex in construction that they can be seriously deformed by the quenching and tempering treatment with consequent decreases in the efficiencies of the turbo-blowers and compressors. When those conventional steel are replaced by a steel as taught by this invention which when annealed for stress relief after welding will acquire the strength and toughness or the properties of a steel refined by quenching and tempering, the process of quenching and tempering can be omitted. Therefore, the impellers of complicate construction will not undergo any deformation and will provide turbo-blowers and compressors with remarkably improved fan efficiencies. The stress-relief annealing after welding is desirably performed within a temperature range of 550° to 650° C. When annealed at above 650° C the steel will hardly develop the strength and the toughness of the refined steel. Temperatures below 550° C will not practically yield the same strength and toughness as refined steel and it is difficult to remove the residual stress caused as a result of welding. We have found that, particularly when such a steel which can be imparted with the properties of the refined steel by the stress-relief annealing after welding is used for turbo-blowers and compressors, the steel at high temperature will display well balanced strength, toughness and hardness, thus smoothening the high-speed running of the impellers and minimizing the interblade resonance and the friction and vibration between the blades and the gas being discharged, with consequent improvements of the waste gas delivery efficiencies.

The component elements of the steel according to the invention are used in amounts within the ranges already specified for the reasons now to be explained.

Carbon is an essential element for expanding the austenitic regions of iron-chromium alloys and enhancing their hardenability and strength. An increase in the carbon content suppresses the precipitation of δ-ferrite, and improves the hardenability, tensile strength, yield strength, and hardness. At the same time, however, the large addition of carbon will decrease the weldability and toughness of the steel and will combine with chromium to form a carbide, thus decreasing the chromium content of the base metal and seriously affecting the corrosion resistance. Under the invention the carbon content has been limited to 0.04 to 0.15% in consideration of the strength and toughness, particularly the weldability and corrosion resistance of the steel.

Chromium produces passivity in varied corrosive environments and is an essential element for the functioning of stainless steel as such. In the presence of nickel and molybdenum, a chromium content of less than 10% will sharply reduce the passivation effect. With more than 16% chromium, on the other hand, the steel will become weak, fragile, and difficult to machine because of large precipitation of δ-ferrite, especially where it has relatively small contents of austenite-stabilizing elements such as carbon and nickel or where it contains much ferrite-yielding elements such as molybdenum and niobium. For these reasons the chromium content in the steel of the invention is restricted to the range from 10 to 16%.

Like carbon, nickel is an austenite-stabilizing element which prevents the precipitation of δ-ferrite and improves the corrosion resistance and hardenability of the steel. Its beneficial actions not possessed by carbon are that it forms a solid solution with the base metal for added strength without adversely affecting the corrosion resistance and weldability and, moreover, it increases the strength and toughness of the steel by enhancing the resistance to softening on tempering. The presence of nickel enables chromium, molybdenum, niobium and other ferrite-producing elements to be added in increased amounts. It also permits a reduction in the amount of carbon which has unfavorable effects on the corrosion resistance, weldability, and toughness of the steel. However, nickel is an element that lowers the $A_1$ transformation point. If more than 6% nickel is added, the tempering temperature of the resulting steel will be limited to a low-temperature range. This will result in not only a decrease of the high-temperature strength but also a lowered Ms point (at which the martensitic transformation starts) and production of retained austenite, which in turn will impair the high-temperature strength and refined properties. In view of these, the upper limit of 6% has been set to the nickel content in the steel of the invention. With less than 3.5% nickel, the steel will form δ-ferrite and become weak, feeble, and difficult to weld where it has nearly maximum contents of ferrite-producing elements such as chromium, molybdenum, and niobium. Moreover, the steel must be preheated to more than 150° C before welding and the refinability after the welding will be impaired. Hence the lower limit of 3.5% of the nickel content.

Molybdenum is a useful element in that it improves the corrosion resistance and strength at room and elevated temperatures of the steel while preventing embrittlement upon tempering. Addition of less than 0.5% molybdenum will fail to achieve these effects, while more than 3% will tend to decrease the toughness, lower the Ms point, and produce retained austenite, with objectionable effects on the yield strength and weldability of the resulting steel. Taking these considerations into account, the molybdenum content has been confined to the range from 0.5 to 3%.

Niobium is a powerful carbide- and nitride- producing element. With a perference over chromium, it forms a carbide and nitride and increases the amount of chromium that forms a solid solution with the base metal, thus making for an improvement of the corrosion resistance. It also reduces the embrittling action of carbon and forms a solid solution with the base metal to increase its yield strength. Further, it makes crystal grains fine and thereby improves the toughness of the steel. However, an increased molybdenum addition will promote the δ-ferrite formation and lead to excessive production of the solid solution with the base metal, precipitation of intermetallic compounds, and hence low toughness. Molybdenum proves useful when added in an amount from 0.5 to 5 times as much as carbon, that is, from 0.01 to 0.8% of the total weight of the composition.

In manufacturing the martensitic stainless steel according to the present invention, a deoxidant need not be added of a vacuum treatment, such a vacuum melting or degassing, is resorted to, and in this case a stainless steel free from any deoxidizing element will result. Where a vacuum treatment is not employed or where more powerful deoxidation is to be carried out, a deoxidizing element must be added. Silicon as the deoxidant slightly improves the corrosion resistance and forms a solid solution with the base metal to strengthen the latter, but an excessive addition will encourage the δ-ferrite precipitation and lower the toughness. The silicon content, therefore, should not exceed 2%.

Where aluminium, titanium, calcium, magnesium or a rare-earth element is to be used as a deoxidant, each should not account for more than 0.2% of the total weight of the steel composition.

Manganese is helpful in stabilizing austenite and increasing the strength. With these additional effects, the element is more than a mere deoxidant and its addition is preferred. Less than 0.2% manganese scarcely proves effective. If the amount is over 2%, the element will combine with nickel to lower the Ms point, giving birth to an excessive amount of retained austenite and reducing the yield strength. For these reasons the manganese content is desired to be between 0.2 and 2%. When the steel composition according to the invention is melted, nitrogen from the atmosphere or from some additional materials for steel-making will find its way into the melt. A small amount of nitrogen added in this way would be welcome because of its austenite-stabilizing and strengthening effects. Therefore, it should be positively incorporated in the steel provided that the amount is never more than 0.2% which will cause a decrease of the toughness.

EXAMPLES

EXAMPLE 1

Figure 1:
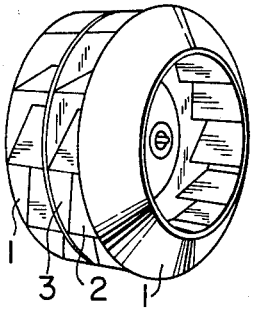
FIGS. 1 through 3 are perspective views of impellers embodying the invention for turbo-blowers and compressors.
Figure 2:
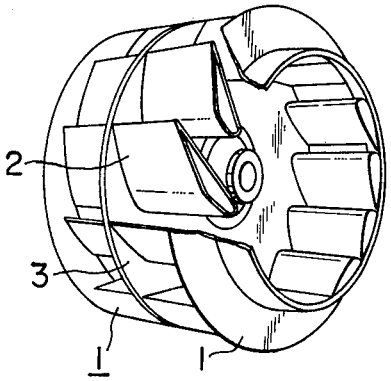
Figure 3:
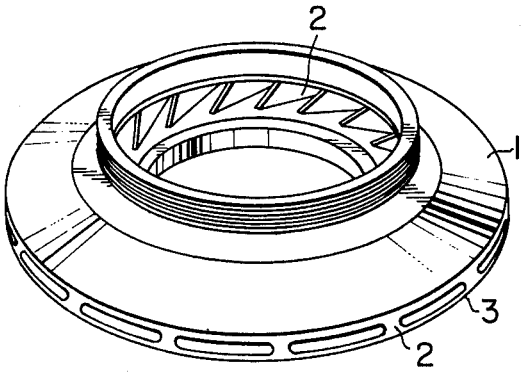

Martensitic stainless steels of the compositions given in Table 1 were tested for the analysis of their mechanical properties and for their tendencies of cracking on welding. In the table the test pieces Nos. 1 to 5 and 8 were of the martensitic stainless steel compositions according to this invention. All were quenched at 1,000° C and tempered at 600° C for 5 hours and then subjected to the tests. The tests pieces Nos. 6 and 7 were commercially available stainless steels. They were quenched at 980° C and then tempered at 600° C or 630° C for 5 hours before the tests. Each test piece was formed by first making a 10 kg steel ingot by a high-frequency furnace, hot working the ingot to a bar form 16 mm in diameter, and then normalizing the bar at 900° C for 3 hours.

Table 1

| Test piece No. | Chemical composition (weight %) | | | | | | | | | | | |
|---|---|---|---|---|---|---|---|---|---|---|---|---|
| | C | Si | Mn | Cr | Ni | Mo | Nb | N | Ti | Al | Ca | Fe |
| 1 | 0.07 | 0.45 | 0.70 | 12.25 | 3.52 | 1.15 | 0.14 | 0.01 | | | | bal. |
| 2 | 0.09 | 0.34 | 0.55 | 12.67 | 3.31 | 1.52 | 0.30 | | 0.02 | | | " |
| 3 | 0.03 | 0.46 | 0.42 | 13.20 | 3.75 | 2.82 | | | | | | " |
| 4 | 0.06 | 0.46 | 0.68 | 11.90 | 5.39 | 0.05 | 0.14 | | | | 0.001 | " |
| 5 | 0.07 | 0.41 | 0.68 | 11.55 | 5.35 | 1.86 | 0.11 | | | 0.01 | | " |
| 6 | 0.13 | 0.64 | 0.75 | 12.38 | 1.74 | | | | | | | " |
| 7 | 0.09 | 0.43 | 0.51 | 12.47 | 0.36 | 0.48 | | | | | " | |
| 8 | 0.05 | 0.44 | 0.68 | 11.25 | 3.61 | 1.92 | 0.17 | | | | | " |

Tables 2 and 3 show the mechanical properties at ordinary temperatures and high temperatures, respectively, of the test steels tempered at 600° C. It will be seen that the test pieces Nos. 1 to 5 and 8 according to the invention exhibit by far the greater impact values than the test pieces Nos. 6 and 7 of the conventional grades. The 0.2% yield strength of over 80 kg/mm$^2$ at ordinary temperatures and over 60 kg/mm$^2$ at high temperatures are clear indications of the high strength and toughness obtained in accordance with the invention. In terms of impact strength, the test pieces of the invention proved much superior to the ordinary test pieces in that their 2 mm U-notch Charpy impact test values exceeded 10 kg-m/cm$^2$ at 20° C whereas the values of the conventional steels were far below that level. At both room and elevated temperatures all of the test pieces according to the invention showed greater strength. It will be clear to those skilled in the art that the steel of the invention having the Charpy impact value of over 8 kg-m/cm$^2$, if used for impellers, will remarkably improve the blower and compressor efficiencies. The high toughness of the steel means that those machines can operate on the safe side and run at high speeds.

Table 2

| Test pc. No. | Temprg temp. (° C) | 0.2% Yld str. (kg/mm$^2$) | Tens. str. (kg/mm$^2$) | Elong. (%) | Contracn (%) | Impact value (kg-m/cm$^2$) |
|---|---|---|---|---|---|---|
| 1 | 600 | 89.0 | 96.5 | 23.3 | 62.8 | 21.0 |
| 2 | 600 | 94.5 | 99.0 | 22.1 | 63.0 | 15.5 |
| 3 | 600 | 97.5 | 106.5 | 23.1 | 64.0 | 14.5 |
| 4 | 600 | 81.0 | 94.0 | 25.1 | 68.5 | 23.5 |
| 5 | 600 | 86.5 | 99.5 | 24.1 | 64.5 | 19.5 |
| 6 | 600 | 81.9 | 92.5 | 22.5 | 61.5 | 3.4 |
| 7 | 600 | 63.1 | 79.3 | 22.3 | 65.4 | 6.5 |
| 8 | 600 | 98.3 | 110.8 | 20.3 | 60.6 | 13.2 |

Table 3

| Test pc No. | Test temp. (° C) | 0.2% Yld str (kg/mm²) | Tensile strength (kg/mm²) | Elongation (%) | Area contraction (%) |
|---|---|---|---|---|---|
| 1 | 450 | 66.5 | 76.5 | 23.3 | 70.2 |
| | 500 | 60.6 | 70.4 | 25.5 | 73.8 |
| 2 | 450 | 69.6 | 75.4 | 23.4 | 68.2 |
| | 500 | 62.7 | 70.3 | 25.6 | 73.0 |
| 4 | 450 | 66.7 | 72.6 | 24.8 | 70.1 |
| | 500 | 60.0 | 66.9 | 25.5 | 73.0 |
| 5 | 450 | 70.1 | 78.6 | 23.6 | 70.1 |
| | 500 | 62.2 | 71.2 | 25.8 | 72.8 |
| 7 | 450 | 54.8 | 62.8 | 25.8 | 71.2 |
| | 500 | 51.2 | 61.1 | 27.1 | 74.1 |
| 8 | 450 | 72.9 | 78.6 | 20.1 | 65.0 |
| | 500 | 69.8 | 75.1 | 23.3 | 69.2 |

EXAMPLE 2

Figure 4:
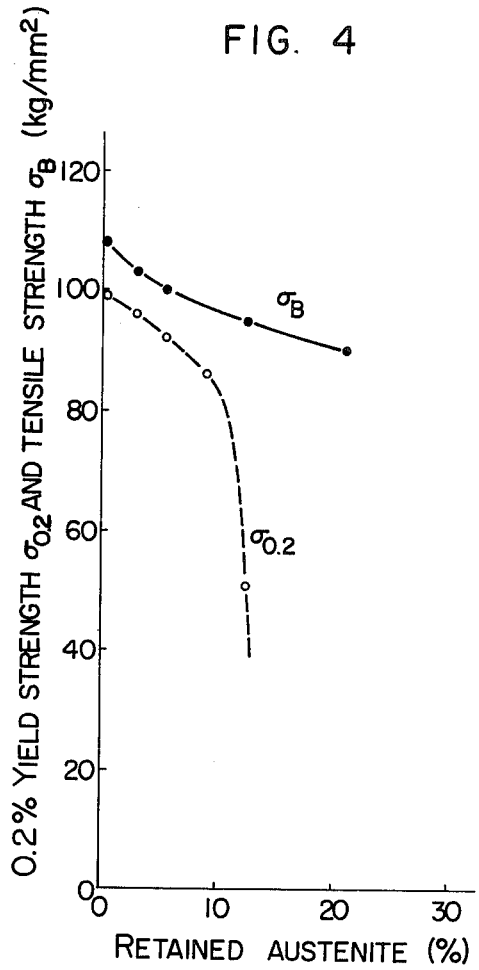
FIG. 4 is a graph illustrating the effect of retained austenite upon the tensile strength of the steel according to the invention.

The test piece No. 8 in Table 2 was quenched and tempered at varying temperatures to control its retained austenite content, and the effect of the content upon the tensile strength of the steel was examined. The results are graphically represented in FIG. 4. As shown, up to 10% retained austenite will not materially weaken the steel, but more than 10% will. In the latter case the 0.2% yield strength decreases drastically, and it will be obvious to those skilled in the art that such a steel cannot make an efficient impeller since the lack of yield strength is accompanied with a lack of high-temperature strength.

EXAMPLE 3

The steels were examined for cracking on welding. For the tests, Lehigh restraint cracking test pieces with single-bevel grooves were arc welded with 4 mm-dia. covered electrodes of mild steel containing 0.08% carbon. Three different preheating temperatures of 50°, 100°, and 150° C were used. The welding was performed with a current of 145 – 155A and arc voltage of 23 – 24V at a speed of 150 – 160 mm/min. After the welding, the test pieces were cooled to 100° C, and kept at 600° C for 5 hours, and then allowed to cool down to room temperature, when the cross sections of their heat affected zones were examined.

Table 4 presents a summary of the cracking test results. The ordinary steel No. 6 cracked even after preheating at 200° C, whereas the steels of the present invention were all free from crack after preheating at as low as 50°, 100°, or 150° C, to say nothing of at 200° C. A welded joint was made of the steel of the invention, No. 2, using an electrode of the above-mentioned composition. The preheating temperature was 100° C and other welding conditions were the same as given above. The welded joint was subjected to a high-temperature tensile test at 450° C, when it displayed a tensile strength of 73.5 kg/mm² before breaking up at the heat affected zone. This indicates that the steel of the invention develops excellent strength.

Table 4

| Test piece No. | Preheating temperature (° C) | Crack development | Crack location |
|---|---|---|---|
| | 50 | No | |
| 1 | 100 | " | |
| | 150 | " | |
| | 50 | No. | |
| 2 | 100 | " | |
| | 150 | " | |
| | 50 | No | |
| 3 | 100 | " | |
| | 150 | " | |
| | 50 | No | |

Table 4-continued

| Test piece No. | Preheating temperature (° C) | Crack development | Crack location |
|---|---|---|---|
| 4 | 100 | " | |
| | 150 | " | |
| | 50 | No | |
| 5 | 100 | " | |
| | 150 | " | |
| | 100 | Yes | Heat affected zone |
| 6 | 150 | " | " |
| | 200 | " | " |

EXAMPLE 4

As a material for turbo-blower and compressor impellers, the martensitic stainless steel of the invention was confirmed to exhibit excellent strength properties and develop no-crack on welding after preheating at low temperature. The impeller shown in FIG. 1, for use with a turbo-blower or compressor, was built of steel plates in refined state having a tensile strength of over 70 kg/mm² at 450° C. The impeller diameter was about 2 meters and the plate thickness was 16 mm. The preheating temperature was 100° C, and after welding with electrodes of the same metal as the impeller material, the structure was annealed at 600° C for stress relieving. The blower efficiency of the turbo-blower equipped with this impeller was determined and was found to be about twice as high as that of a similar turbo-blower made of a conventional carbon steel. As examples of the steel that satisfies the foregoing requirements, the grades of the invention given in Table 1 may be used to manufacture impellers which will improve the turbo-blower and compressor impellers which will improve the turbo-blower and compressor efficiencies. Thus, while the particular compositions shown in Table 1 are most preferred forms of the steel according to the invention, it is to be understood that modifications will be apparent to those skilled in the art without departing from the spirit of the invention.

As has been described hereinabove, the steel of the invention when used for the impellers of turbo-blowers and compressors will permit the latter to have high efficiencies, although the number of man-hours required for the construction is considerably saved.

What is claimed is:

1. An impeller for gas handling apparatus comprising:
an annular center plate;
annular side plates each arranged at either side of the plane of said center plate with a predetermined spaced therebetween;
a plurality of blades arranged circumferentially with respect to one another and affixed to each of said center plate and said side plates in the substantially axial direction;
a shaft disposed in the center of said arranged blades;
said center plate, said side plates and said blades being made of a martensite alloy steel consisting essentially, based on weight, of 0.04 – 0.15% of carbon, up to 2% of silicon, 0.2 – 2.0% of manganese, 3.5 – 6.0% of nickel, 10 – 16% of chromium, at least one element selected from the group consisting of 0.5 – 3.0% of molybdenum and 0.01 – 0.8% niobium, and the balance iron and inevitable impurities; and
said center plate being joined to said side plates and said blades by welding.

2. An impeller according to claim 1, wherein said alloy steel contains up to 10% of retained austenite.

3. An impeller according to claim 1, wherein said center plate, said side plates and said blades range in thickness from 0.5 to 1.5% of the diameter of said impeller.

4. An impeller according to claim 1, wherein said alloy steel contains up to 10% of δ-ferrite.

5. An impeller according to claim 4, wherein said alloy steel contains up to 10% of retained austenite.

6. An impeller for gas handling apparatus comprising:

an annular center plate;

annular side plates each arranged at either side of the plane of said center plate with a predetermined spacing therebetween;

a plurality of blades arranged circumferentially with respect to one another and affixed to each of said center plate and said side plates in the substantially axial direction;

a shaft disposed in the center of said arranged blades;

said center plates, said side plates and said blades consisting essentially, based on weight, of 0.04 – 0.15% of carbon, up to 2% of silicon, 0.2 – 2.0% of manganese, 3.5 – 6.0% of nickel, at least one element selected from the group consisting of 0.5 – 3.0% of molybdenum and 0.01 – 0.8% of niobium, at least one element selected from the group consisting of up to 0.2% each of nitrogen, aluminum, titanium, calcium, magnesium and rare earth elements, and the balance iron and inevitable impurities; and said center plate being joined to said side plates and said blades by welding.

7. An impeller according to claim 6, wherein said alloy steel contains up to 10% of δ-ferrite.

8. An impeller according to claim 6, wherein said alloy steel contains up to 10% of retained austenite.

9. An impeller according to claim 6, wherein said center plate, said side plates and said blades range in thickness from 0.5 to 1.5% of the diameter of said impeller.

10. An impeller according to claim 9, wherein said alloy steel contains up to 10% of retained austenite.

11. An impeller for gas handling apparatus comprising:

a plurality of blades arranged circumferentially with respect to one another and affixed to each of said plates in the substantially axial direction;

a shaft disposed in the center of said arranged blades;

said plates and said blades being made of a martensite alloy steel consisting essentially, based on weight, of 0.04 – 1.5% of carbon, up to 2.0% of silicon, 0.2 – 2.0% of manganese, 3.5 – 6.0% of nickel, 10 – 16% of chromium, at least one element selected from the group consisting of 0.5 – 3.0% of molybdenum and 0.01 – 0.8% of niobium, and the balance iron and inevitable impurities; and said plates being joined to said blades by welding.

12. An impeller according to claim 11, wherein said alloy steel contains up to 10% of δ-ferrite.

13. An impeller according to claim 11, wherein said plates and said blades range in thickness from 0.5 to 1.5% of the diameter of said impeller.

14. An impeller for gas handling apparatus comprising:

a pair of annular plates;

a plurality of baldes arranged circumferentially with regard to one another and affixed to each of said plates in the substantially axial direction;

a shaft disposed in the center of said arranged blades;

said plates and said blades being made of a martensite alloy steel consisting essentially, based on weight, of 0.4 – 0.15% of carbon, up to 2% of silicon, 0.2 – 2.0% of manganese, 3.5 – 6.0% of nickel, 10 – 16% of chromium, at least one element selected from the group consisting of 0.5 – 3.0% of molybdenum and 0.01 – 0.8% of niobium, at least one element selected from the group consisting of up to 0.2% each of nitrogen, aluminum, titanium, calcium, magnesium and rare earth elements, and the balance iron and inevitable impurities; and said plates being joined to said blades by welding.

15. An impeller according to claim 14, wherein said alloy steel contains up to 10% of δ-ferrite.

16. An impeller according to claim 14, wherein said alloy steel contains up to 10% of retained austenite.

17. An impeller according to claim 14, wherein said plates and said blades range in thickness from 0.5 to 1.5% of the diameter of said impeller.

18. An impeller according to claim 12, wherein said alloy steel contains up to 10% of retained austenite.

19. An impeller according to claim 12, wherein said plates and said blades range in thickness from 0.5 to 1.5% of the diameter of said impeller.

20. An impeller according to claim 15, wherein said alloy steel contains up to 10% of retained austenite.

21. An impeller according to claim 15, wherein said plates and said blades range in thickness from 0.5 to 1.5% of the diameter of said impeller.

22. An impeller according to claim 10, wherein said plates and said blades range in thickness from 0.5 to 1.5% of the diameter of said impeller.

23. An impeller according to claim 16, wherein said plates and said blades range in thickness from 0.5 to 1.5% of the diameter of said impeller.

24. An impeller according to claim 18, wherein said plates and said blades range in thickness from 0.5 to 1.5% of the diameter of said impeller.

* * * * *